US011542671B2

(12) United States Patent
de la Coliniere et al.

(10) Patent No.: US 11,542,671 B2
(45) Date of Patent: Jan. 3, 2023

(54) CANTILEVERED EXPANSION FINGER JOINT APPARATUS

(71) Applicant: MARCONMETALFAB INC., Delta (CA)

(72) Inventors: Eric de Fleuriot de la Coliniere, Langley (CA); Casey Xi Wang, Maple Ridge (CA); Duncan Robert Bohlmann, Vancouver (CA)

(73) Assignee: MARCONMETALFAB INC., Delta (CA)

( * ) Notice: Subject to any disclaimer, the term of this patent is extended or adjusted under 35 U.S.C. 154(b) by 62 days.

(21) Appl. No.: 17/112,867

(22) Filed: Dec. 4, 2020

(65) Prior Publication Data

US 2021/0189670 A1 Jun. 24, 2021

Related U.S. Application Data

(60) Provisional application No. 62/950,022, filed on Dec. 18, 2019.

(51) Int. Cl.
*E01D 19/06* (2006.01)
*E01D 22/00* (2006.01)

(52) U.S. Cl.
CPC ..... *E01D 19/065* (2013.01); *E01D 22/00* (2013.01)

(58) Field of Classification Search
CPC ..... E01D 19/065; E01D 22/00; E01D 19/06
See application file for complete search history.

(56) References Cited

U.S. PATENT DOCUMENTS

| | | | | |
|---|---|---|---|---|
| 3,603,626 | A * | 9/1971 | Whiteside | F16B 19/02 411/57.1 |
| 6,402,427 | B1 * | 6/2002 | James | E04G 23/0233 405/150.2 |
| 6,609,265 | B1 * | 8/2003 | Jee | E01D 19/06 14/73.1 |
| 7,484,259 | B2 * | 2/2009 | Xu | E01D 19/06 14/73.1 |
| 10,087,591 | B1 * | 10/2018 | Moore | E01D 19/065 |
| 2010/0263312 | A1 * | 10/2010 | Bradford | E01D 19/065 52/468 |
| 2017/0073910 | A1 * | 3/2017 | Koo | E01D 19/06 |
| 2020/0002906 | A1 * | 1/2020 | Moore | E01C 11/106 |

FOREIGN PATENT DOCUMENTS

| | | |
|---|---|---|
| CA | 3014382 | 4/2019 |
| JP | 2018119287 | 8/2018 |
| KR | 1020180112408 | 10/2018 |
| KR | 101951734 | 2/2019 |

* cited by examiner

*Primary Examiner* — Abigail A Risic
(74) *Attorney, Agent, or Firm* — Davis Wright Tremaine LLP; Heather M. Colburn

(57) ABSTRACT

A roadway expansion joint apparatus comprises at least one finger joint that extends across an expansion gap. Each finger joint comprises a base plate, a finger unit, a pivot and a cantilever support. The finger unit comprises a body and at least one unsupported finger extending longitudinally from a distal end of the body. The pivot pivotally couples the finger unit to the base plate about a vertical pivot axis. The cantilever support is located at or between the pivot and a proximal end of the finger unit; the cantilever support allows pivoting of the finger unit relative to the base plate about a vertical pivot axis and impedes pivoting of the finger unit relative to the base plate about a horizontal axis, thereby cantilevering the finger joint to the base plate at the cantilever support.

11 Claims, 11 Drawing Sheets

CANTILEVERED EXPANSION FINGER JOINT APPARATUS

CROSS REFERENCE TO RELATED APPLICATION(S)

This application claims the benefit of U.S. Provisional Application No. 62/950,022, filed on Dec. 18, 2019, which is incorporated herein by reference in its entirety.

FIELD

This disclosure relates generally to an expansion finger joint apparatus for use in bridge and other roadway expansion gaps.

BACKGROUND

An expansion finger joint system known in the art typically comprises a pair of finger joints that face each other across an expansion gap of a bridge or other roadway components, each with longitudinally protruding fingers that intermesh across the expansion gap. The intermeshing fingers support vehicles that cross the expansion gap, yet allow the expansion gap to change e.g. due to a change in temperature. Known expansion finger joint systems are typically designed to accommodate a full range of movement of the bridge or roadway either in expansion or contraction while supporting traffic across the expansion gap. When the gap is at its largest, the opposing fingers move apart from each other but are prevented by the design length of the fingers from forming a continuous transverse gap between finger tips. When the gap is at its narrowest the fingers move towards each other but never fully engage such that there always remains a small gap between the male end of a finger on one side of the joint gap and its opposite female end of the finger on the other side of the expansion gap.

Prior art finger joint systems which have fingers rigidly attached to both sides of the joints cannot accommodate any or very little differential lateral movements and rotations about a vertical axis of the bridge. When these lateral movements and rotations occur, the fingers encounter each other and either jam up or break resulting in adverse effects to the bridge.

Some prior art finger joint systems have been proposed which provide finger joints that are rotatable about a vertical axis, thereby accommodating the movements and rotations of the bridge. These prior art joints remain structurally stable by being supported on both sides of the expansion gap. The finger tips rest and slide on the steel plates as the gap increases and decreases. However, these joints would be structurally unstable if support from either side of the gap was removed. Supporting the fingers on both sides of the expansion gap requires sliding surfaces which are exposed to debris, dirt and road grime and consequently susceptible to wear and tear. In addition unmaintained finger gaps jammed with debris and dirt will also result in limitation in joint performance and movement capacity. Examples of such prior art finger joint systems are: CA 3,014,382, JP 2018-119287 and KR 10-1951734.

It is therefore desirable to provide a solution to at least some of the existing challenges faced by prior art devices. In particular, it is desirable to provide an expansion finger joint apparatus that can support traffic across an expansion joint gap while accommodating an unrestricted range of deck movements including lateral, longitudinal, vertical and rotational about both the vertical and horizontal axes whilst not needing any support of the finger tips.

SUMMARY

Figure 1:
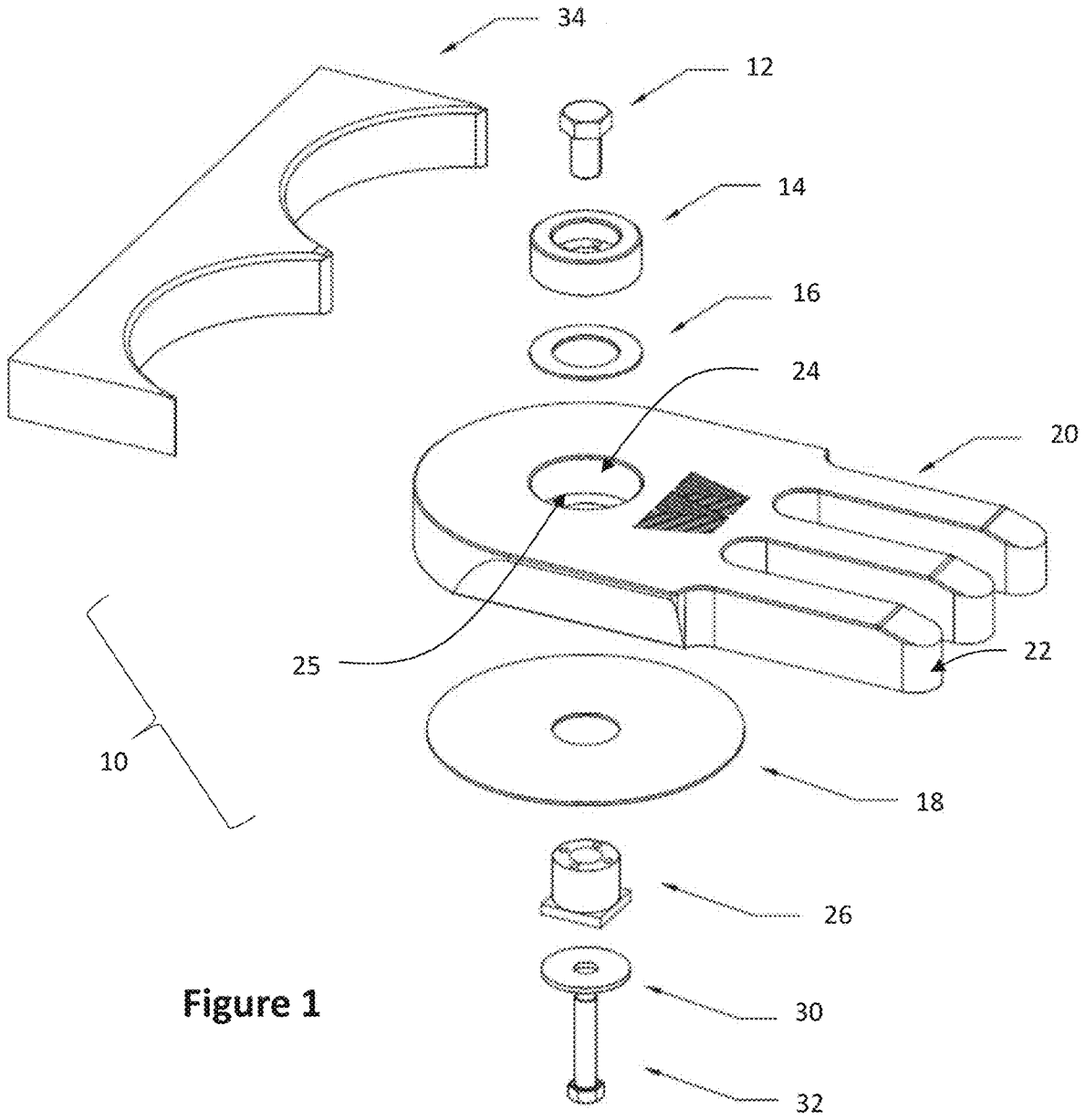
FIG. 1 is an exploded perspective view of a cantilevered expansion finger joint comprising a cantilever mechanism having a rigid collar, according to a first embodiment of a finger joint apparatus.
Figure 2:
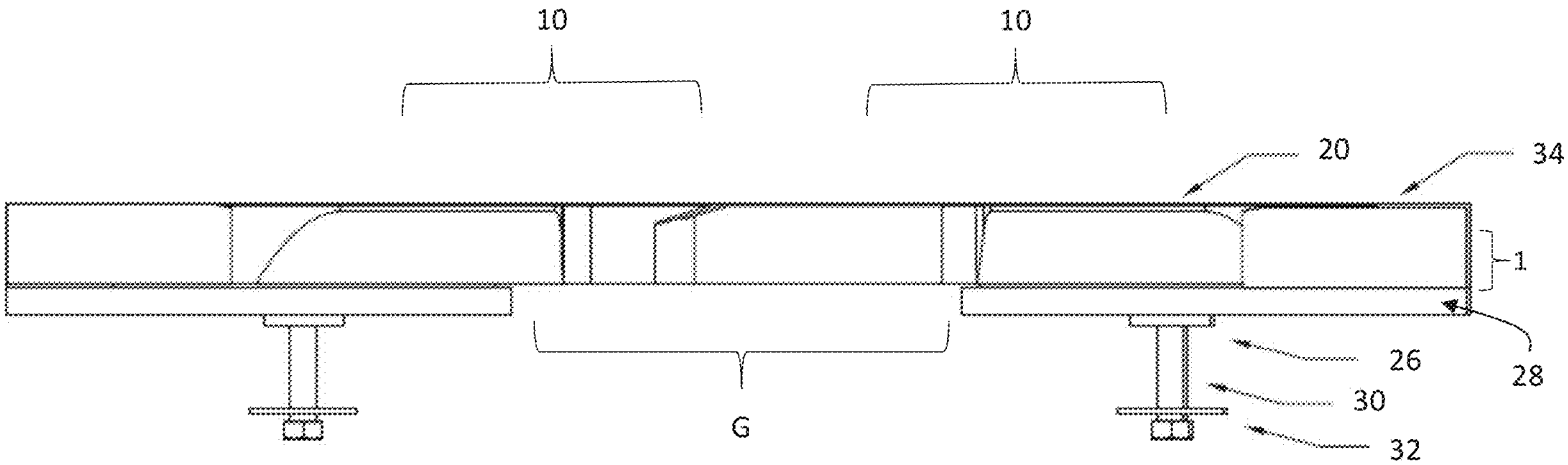
FIG. 2 is a side elevation view of two of the expansion finger joints as shown in FIG. 1, in opposing intermeshing engagement and extending across an expansion gap.

According to one aspect of the invention, there is provided a roadway expansion joint apparatus comprising at least one finger joint for extending across an expansion gap. In some aspects, the apparatus comprises one or more pairs of finger joints, wherein for each pair, a first finger joint faces a second finger joint of the pair and are spaced apart across the expansion gap, and wherein fingers from the first and second finger joints of the pair intermesh over the expansion gap. Each finger joint comprises a support for anchoring to a surface of a supporting structure, a finger unit, a pivot mechanism and a cantilever mechanism. The finger unit comprises a body and at least one unsupported finger extending longitudinally from a distal end of the body. The pivot mechanism pivotally couples the finger unit to the support and allows rotation about a pivot axis on a sliding plane parallel to a top surface of the support. The cantilever mechanism contacts the finger unit to provide cantilever support to the one or more fingers, wherein rotation within the sliding plane is allowed but rotation out of the sliding plane is prevented.

The pivot mechanism can further comprise a pivot bore extending through the finger unit body along the pivot axis, and the cantilever mechanism can further comprise a rigid collar slidably seated in the pivot bore and fastened to the support such the finger unit is rotatable relative to the collar about the pivot axis but fixed relative to the collar about any other axis. The collar can be seated and the pivot mechanism can comprise a top sliding surface, a bottom sliding surface and a top anchor fastener. The top sliding surface is seated in the collar, and the bottom sliding surface is located between the finger unit and the support. The top anchor fastener is seated on the top sliding surface and extends through the top sliding surface, the collar, the bottom sliding surface and is fixed to the support. The top and bottom sliding surfaces have a low friction surface permitting the finger unit to slide relative to the collar and the support when the top anchor fastener is connected to the support.

Alternatively or additionally, the cantilever mechanism can comprise a flange fixed to the support and an extension fixed to the finger unit. The flange overlaps the extension in a plane parallel to the sliding plane, thereby impeding pivoting of the finger unit out of the sliding plane. The extension is laterally slidable relative to the flange thereby allowing pivoting of the finger unit in the sliding plane about the pivot axis only.

Alternatively or additionally, the cantilever mechanism can comprise a flange fixed to the support, wherein the flange overlaps the proximal end of the finger unit in a plane parallel to the sliding plane, thereby impeding pivoting of the finger unit out of the sliding plane. The proximal end of the finger unit is laterally slidable relative to the flange thereby allowing pivoting of the finger unit in the sliding plane about the pivot axis only. Further, the proximal end of the finger unit can comprise a cut out corresponding to a thickness of the flange, such that top surfaces of the flange and finger unit are flush.

The finger unit body can further comprise a top surface, a bottom surface and side surfaces that taper inwardly from the top surface to the bottom surface. When the apparatus comprises multiple pairs of the finger joints, wherein the first finger joint of each pair are positioned side-by-side on one side of an expansion gap and the second finger joint of each pair are positioned side-by-side on an opposite side of the expansion gap, the inwardly tapering side surfaces of adjacent finger units define a debris evacuation channel therebetween.

The pivot mechanism can further comprise a spring compressed along the pivot axis and expandable upon wear of the top or bottom sliding surface to maintain the pivot mechanism in contact with the finger unit. The spring can be composed of an elastic compressible material such as urethane or rubber.

DETAILED DESCRIPTION OF EMBODIMENTS

Embodiments disclosed herein relate generally to a cantilevered expansion finger joint apparatus for supporting vehicles crossing a bridge or roadway expansion gap. In some embodiments, the expansion finger joint apparatus comprises a plurality of opposed pairs of finger joints each comprising fingers which intermesh across an expansion gap. Each finger joint comprises a support such as a base plate, a finger unit with a body and one or more unsupported fingers extending longitudinally outwards from a distal end of the body, and a pivot mechanism which pivotably couples the finger unit to the base plate to allow rotation about a pivot axis and on a sliding plane parallel to a top surface of the base plate. The finger joint also comprises a cantilever mechanism contacting the finger unit and which allows the finger unit to pivot relative to its base plate within the sliding plane, yet impedes the finger unit from pivoting out of the sliding plane. Consequently, the finger joint is cantilevered and pivotable relative to the base plate within the sliding plane, and the fingers can extend across the expansion gap without being supported at their proximal ends.

Figure 3:
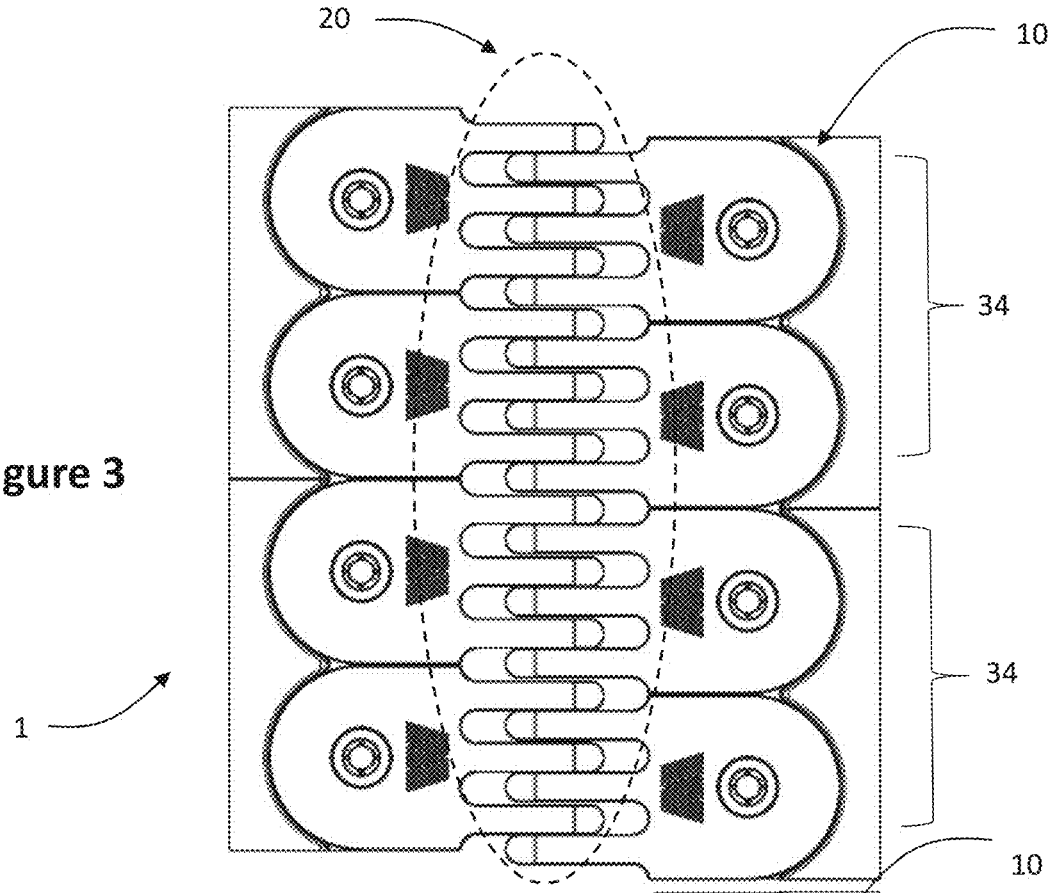
FIG. 3 is a first top plan view of eight of the expansion finger joints shown in FIG. 1, arranged in four opposing pairs in intermeshing engagement across a transversely aligned expansion gap.
Figure 4:
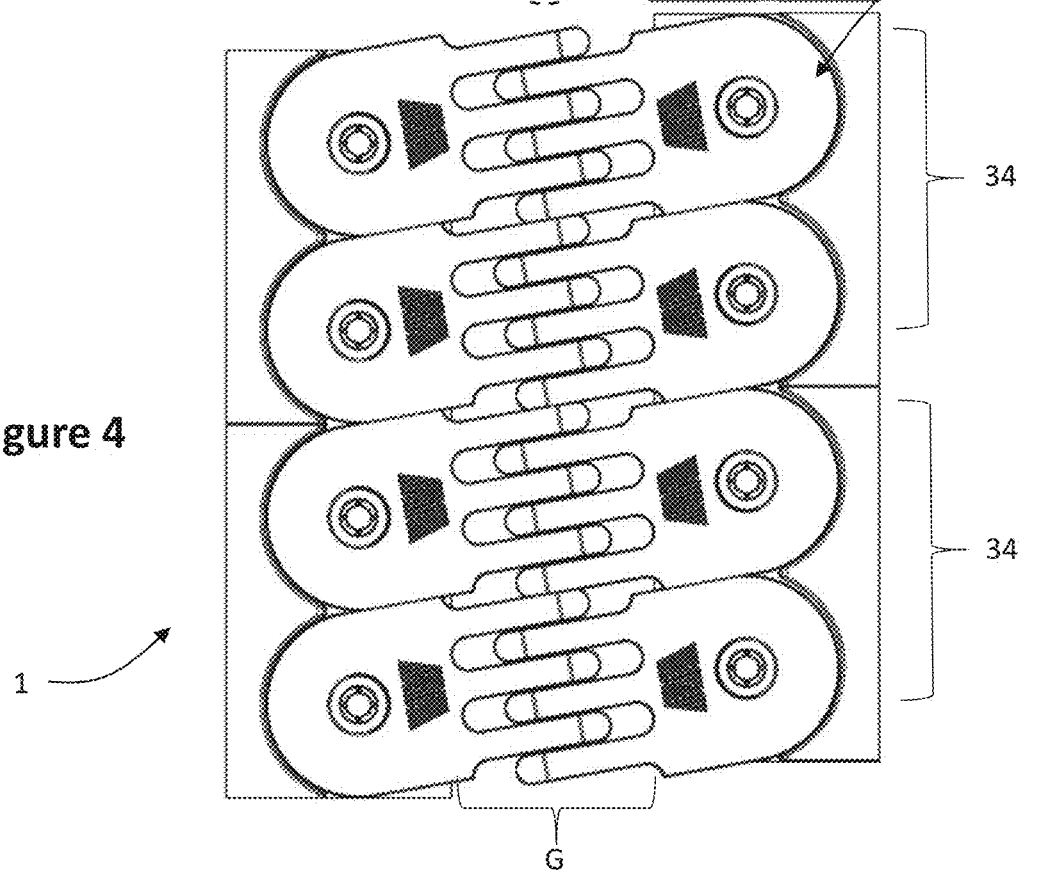
FIG. 4 is a second top plan view of the eight expansion finger joints shown in FIG. 1, arranged across a transversely offset expansion gap.
Figure 5:
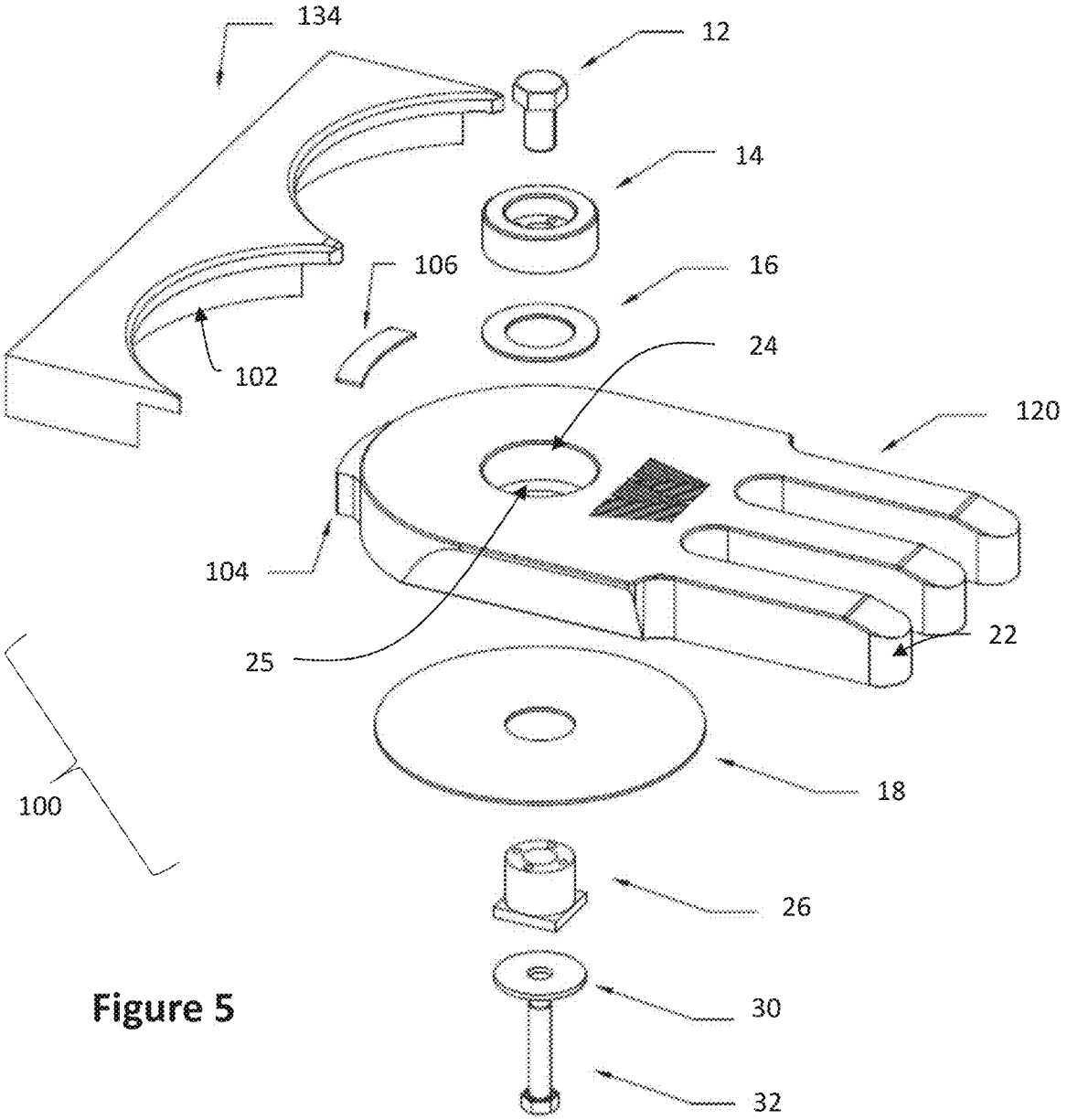
FIG. 5 is an exploded perspective view of a cantilevered expansion finger joint, comprising a cantilever mechanism having a back plate flange and a finger unit extension, according to a second embodiment of the finger joint apparatus.
Figure 6:
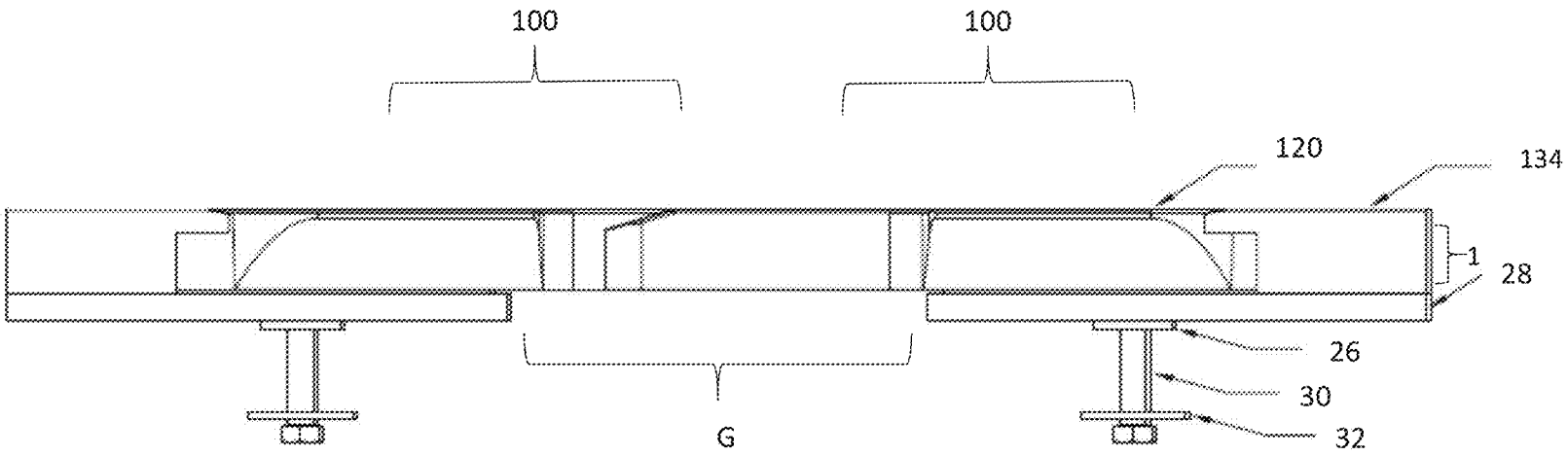
FIG. 6 is a side elevation view of two of the expansion finger joints as shown in FIG. 5, in opposing intermeshing engagement and extending across an expansion gap.
Figure 7:
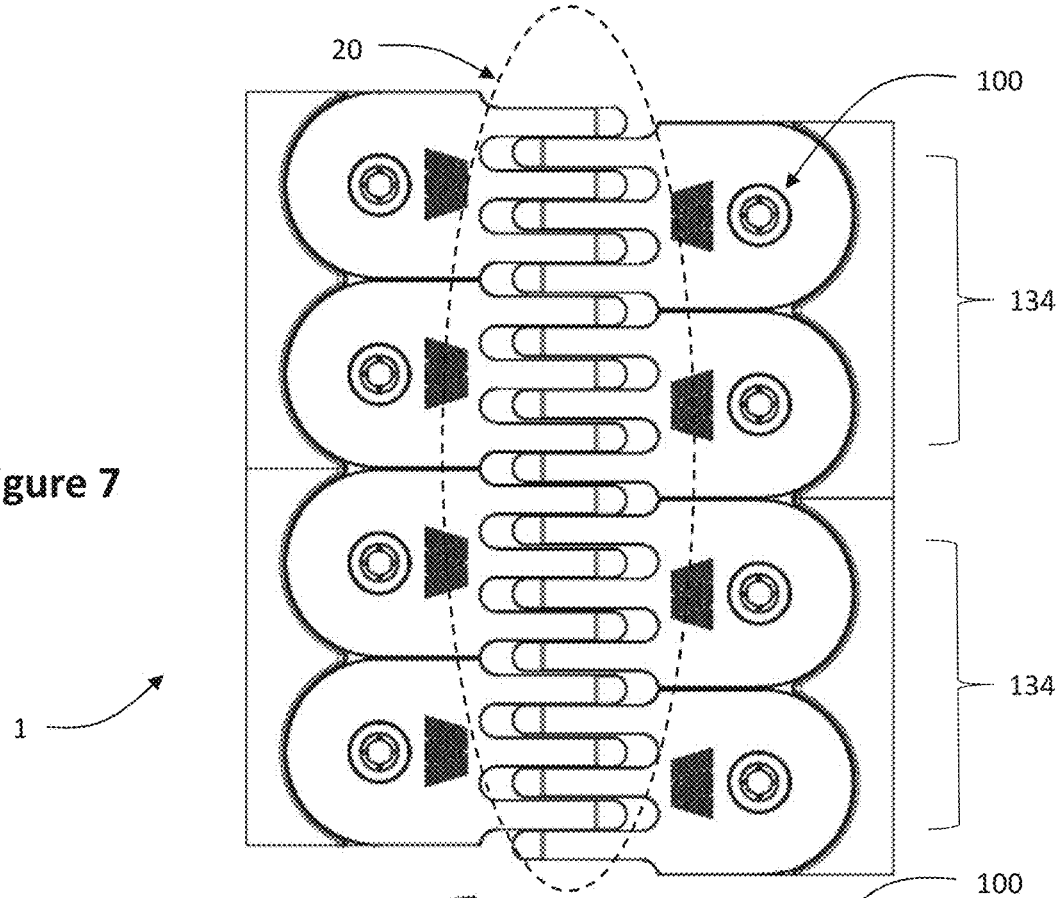
FIG. 7 is a first top plan view of eight of the expansion finger joints shown in FIG. 5, arranged in four opposing pairs in intermeshing engagement across a transversely aligned expansion gap.
Figure 8:
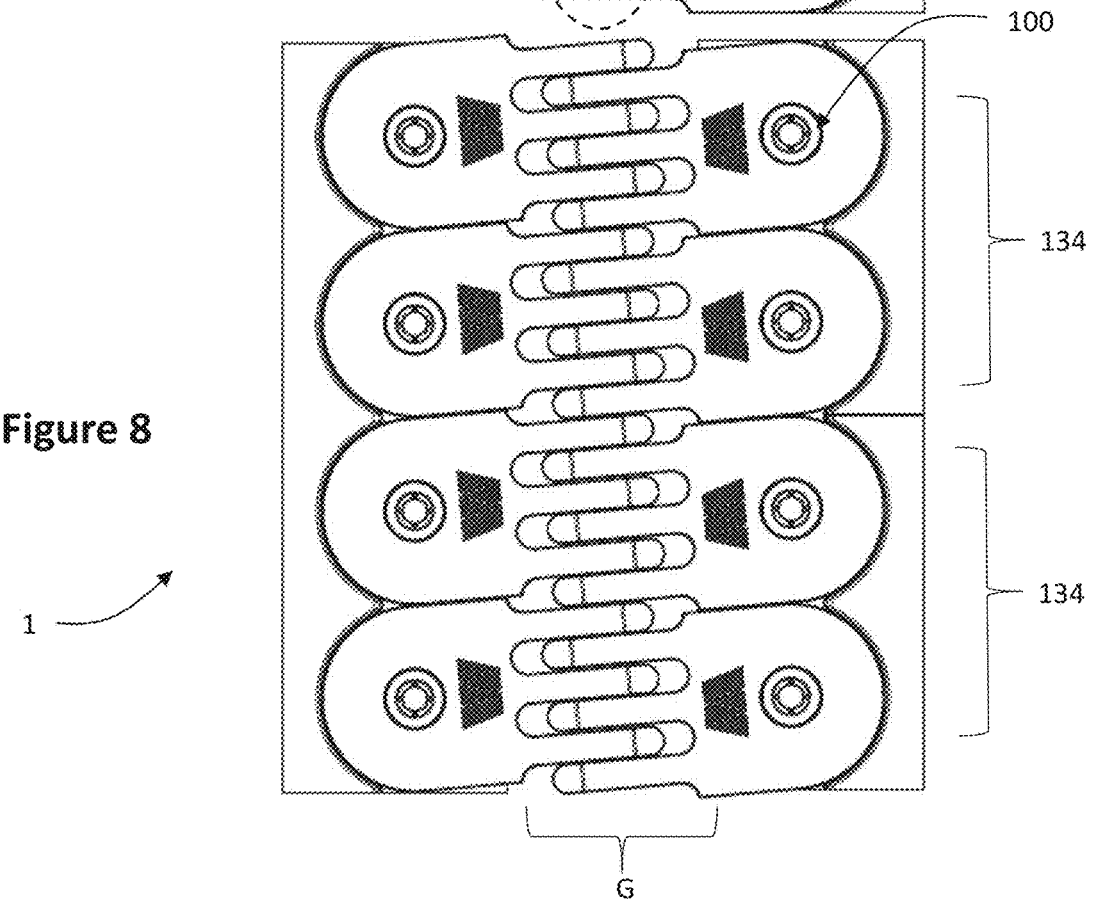
FIG. 8 is a second top plan view of the eight expansion finger joints shown in FIG. 5, arranged across a transversely offset expansion gap.
Figure 9:
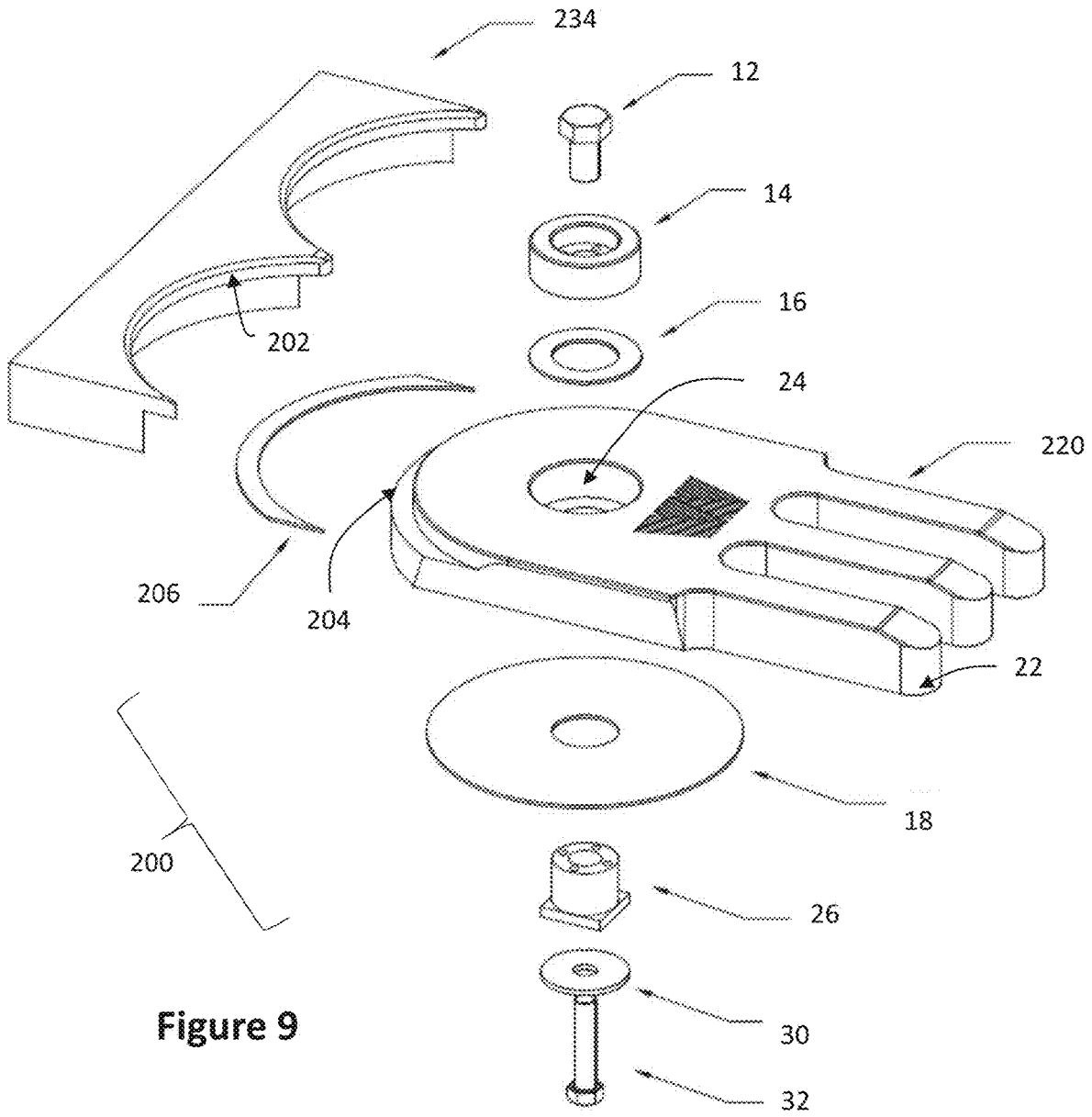
FIG. 9 is an exploded perspective view of a cantilevered expansion finger joint, comprising a cantilever mechanism having a back plate flange and a finger unit cut-out, according to a third embodiment of the expansion joint apparatus.
Figure 10:
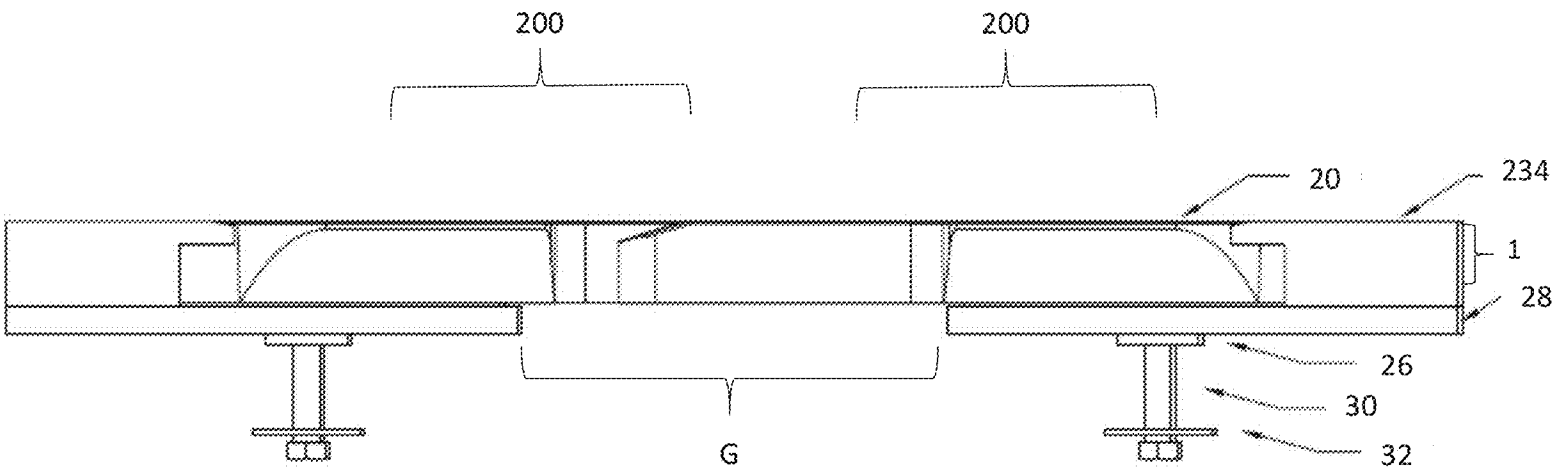
FIG. 10 is a side elevation view of two of the expansion finger joints as shown in FIG. 9, in opposing intermeshing engagement and extending across an expansion gap.
Figure 11:
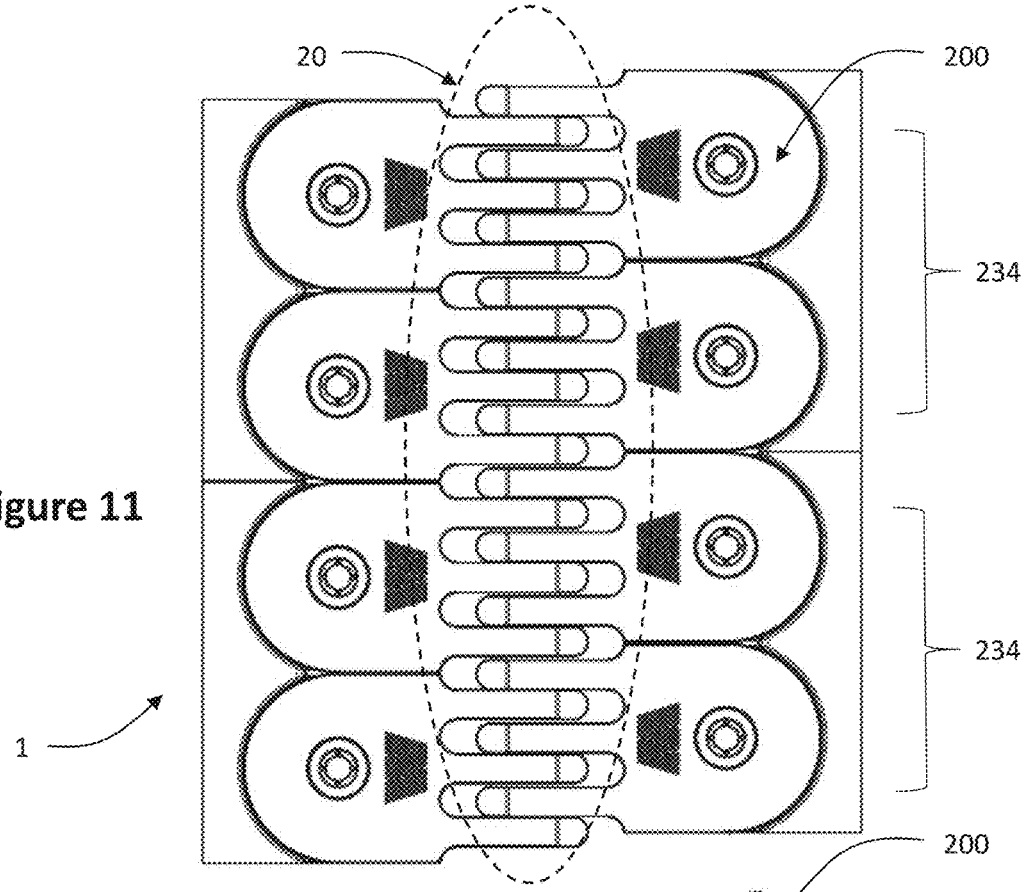
FIG. 11 is a first top plan view of eight of the expansion finger joints shown in FIG. 9, arranged in four opposing pairs in intermeshing engagement, across a transversely aligned expansion gap.
Figure 12:
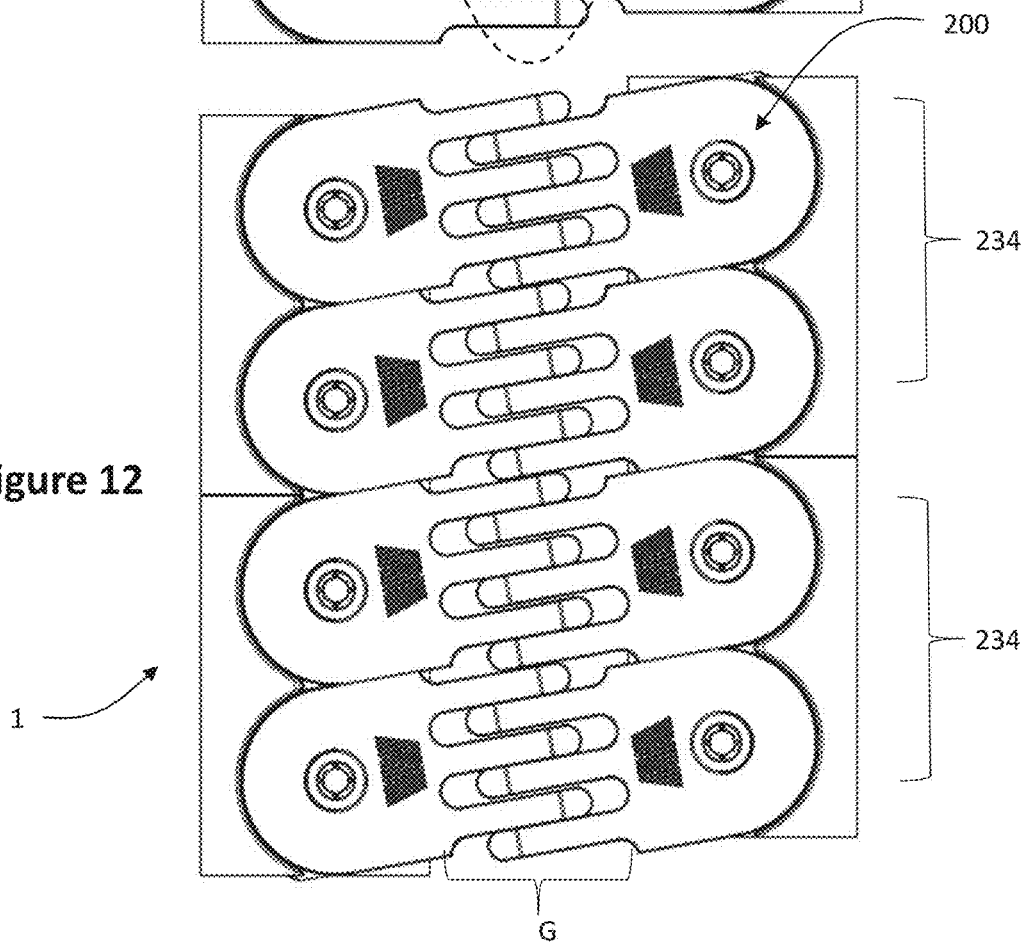
FIG. 12 is a second top plan view of the eight expansion finger joints shown in FIG. 9, arranged across a transversely offset expansion gap.

According to a first embodiment and referring to FIGS. 1 to 4, a cantilevered expansion finger joint apparatus 1 comprises pairs of pivotable expansion joints 10 that are positioned side-by-side across an expansion gap G of a bridge or other roadway with fingers 22 from opposed expansion joints 10 in intermeshing engagement (see FIGS. 3 and 4). The required number of pairs of expansion joints 10 in the apparatus 1 will depend on the number required to span the width of the bridge or roadway.

A single expansion joint 10 is shown in FIG. 1 in exploded view. In this embodiment, the cantilevering mechanism is provided by a rigid collar in a pivot mechanism of the expansion joint 10. In this embodiment, the pivot mechanism comprises a top anchor bolt 12, a rigid collar 14, a top sliding ring 16, and a bottom sliding ring 18. However, the top anchor bolt can be substituted by a suitable fastener known in the art, and the top and bottom sliding rings can be substituted by other sliding surfaces known in the art. A finger unit 20 of the expansion joint 10 comprises a body and a plurality of fingers 22 extending longitudinally from a distal end of the finger unit body. The finger unit body has a top surface, bottom surface, and side surfaces, and a pivot bore 24 which extends through the body from the top surface to the bottom surface. The pivot bore 24 has an annular seat 25 and the top sliding ring 16 is seated in the bore 24 with the rigid collar 14 seated on the top sliding ring 16. The collar 14 also comprises an annular seat, and when a head of the top anchor bolt 12 sits on the collar seat, a threaded body of the top anchor bolt 12 extends through the collar 14, top sliding ring 16, bottom sliding ring 18 and threads into a base plate anchor 26, which in turn is welded or otherwise affixed to a base plate 28 (not shown in FIG. 1 but shown in FIG. 2). The top anchor bolt 12 is torqued tight onto the collar 14, effectively anchoring the collar 14 to the base plate 28 via the base plate anchor 26 and preventing the pivot mechanism from vibrating.

The base plate anchor 26 forms the fulcrum about which the finger unit 20 rotates, and is designed to anchor to a supporting structure and resist lateral forces from traffic such as braking and centrifugal forces on curved bridges. Although a base plate is featured in this embodiment, other types of support for anchoring to a supporting structure can be provided.

The collar 14 prevents the top anchor bolt 12 from coming undone during normal operation of the apparatus 1, while allowing the finger unit 20 to rotate relative to the collar 14. The collar 14 has locating pins or key(s) on its face (not shown) which fixedly connect the collar 14 to the base plate anchor 26, and locates the top sliding ring 16 between the collar 14 and the bore seat. Consequently, the collar 14 allows the finger unit 20 to rotate about the pivot axis in a sliding plane and freely from the top anchor bolt 12, while impeding the finger unit 20 from rotating out of the sliding plane and causing the fingers 22 to sag when weight is applied to the finger unit 20 across the expansion gap. In other words, the collar is a cantilever mechanism that provides a cantilever support by way of the top anchor bolt 12 being tensioned against the collar 14, which is seated in the bore of the finger unit 20. The finger unit 20 in turn is seated on the bottom sliding ring 18 which is laying on top of the base plate 28, thereby preventing the finger unit 20 from pivoting about the horizontal axis relative to the base plate 28.

The top sliding ring 16 and bottom sliding ring 18 are composed of a low-friction high strength material that allows the finger unit 20 to slide freely with minimal restraint from the top anchor bolt 12 and the collar 14 and at the same time resist the loads from traffic. Such materials are readily available in the art and thus are not described in detail here.

A bottom anchor assembly can consist of any known type of device allowing anchoring into concrete; in the shown embodiment, the bottom anchor assembly consists of plate 30 (round or square) and a bottom anchor rod 32 connected to the base plate anchor 26 by any means and extending downwardly from the base plate 28. The base plate anchor 26 is welded to the underside of the base plate 28 to prevent the base plate anchor 26 from rotating in the vertical axis. Base plate anchor 26 in combination with top anchor bolt 12 and bottom anchor rod 32 secure the entire apparatus to base plate 28. Base plate 28 is in turn secured into the concrete bridge deck by Nelson studs (not shown). When secured, the bottom anchor assembly together with contributions from the base plate 28 resists uplift forces generated during tightening of the top anchor bolt 12, as well as resisting uplift forces generated from the rotating finger unit 20 under traffic loads.

A back plate 34 extends upward from the base plate 28 and has a top surface that sits flush with the top surface of the finger unit 20. The back plate 34 shown in FIG. 1 is configured with a pair of curved side surfaces which correspond to two side-by-side finger units (see FIGS. 3 and 4); alternatively, the back plate 34 can be configured with a single curved side surface to correspond to one finger unit, or with three or more curved side surfaces to correspond to three or more finger units (not shown).

Optionally and as shown in FIG. 1, the finger joints 10 are provided with a debris evacuation channel wherein the sides of each finger unit 20 taper inwards from the top surface to the bottom surface of the finger unit body. When two finger joints 10 are positioned side-by-side, the evacuation channel has a small gap at the top surface of adjacent finger units 20 which increases towards the bottom surface of the adjacent finger units 20. This tapering evacuation channel impedes larger sized debris from falling between finger joints 10, while allowing smaller sized debris to fall into the channel and avoid being compacted by passing traffic. The debris that has fallen to the bottom of the channel can be flushed away from the apparatus 1, e.g. by rainfall, through a drain in the expansion gap (not shown).

Optionally and as shown in FIG. 1, the distal ends of the fingers 22 are sloped to allow for bridge/roadway deck rotation and to prevent the fingers from protruding into traffic or coming into contact with snow plough blades.

Referring now to FIGS. 3 and 4, the finger joint apparatus 1 is shown in operation, supporting vehicular traffic across an expansion gap G while accommodating the full range of bridge deck movement, including lateral, longitudinal, and rotational about a vertical axis, and rotational about a horizontal axis. When the bridge is correctly aligned as shown in FIG. 3, the fingers 22 of the finger units 20 extend along a normal direction relative to the apparatus 1. When the bridge moves and the expansion gap shifts transversely as shown in FIG. 4, the finger units 10 rotate about the vertical pivot axis, while the fingers 22 maintain contact with each other, resulting in no restraining force (apart from the effects of friction) that can be transferred to the bridge components on both sides of the expansion gap G.

It is expected that the finger joint apparatus 1 will be particularly useful in certain expansion gap locations that are challenging for prior art rigidly fixed finger joints, including:

- At abutments of very skew bridges—the normal forward rotation of these abutments results in a twisting effect or rotation of the deck in plan which would cause rigidly fixed fingers to jam up;
- Where differential lateral forces are felt by deck components on opposite sides of an expansion gap during a seismic event;
- Where differential settlement occurs across the width of abutments on very wide bridges and which could result in variations in lateral movement between the opposite components of bridges at an expansion joint;
- At expansion gaps on curved bridges (in plan)—the forces resulting from abutments or by other means can cause the bridge to rotate in plan and cause differential movement at an expansion gap between two opposite components of the bridge; and
- Where there exist differences in temperature between two opposite sides of a gap which results in differential expansion and contraction along the length of the gap which could cause rigidly fixed fingers to jam up.

Referring now to FIGS. 5 to 8 and according to a second embodiment, a cantilevered expansion finger joint apparatus 100 is similar to the apparatus 1 shown in FIGS. 1 to 4, with the notable exception that the cantilever mechanism further comprises a flanged back plate 120 and an extension on the finger unit 120 that slidably engages the flanged back plate 120 along a plane parallel to the sliding plane. When loaded by traffic over the gap, the finger unit 120 is prevented from rotating out of the sliding plane by means of the flanged back plate 134 and the extended finger unit 120. More particularly, the back plate 134 is provided with a curved flange 102 that extends from the top surface of the back plate 134 towards the finger unit, and the finger unit 120 is provided with a curved extension 104 that extends from the bottom surface of the finger unit 120 towards the back plate 134. A low-friction sliding layer 106 is affixed on the top surface of the extension 104 (or alternatively to the bottom surface of the flange 102). When the apparatus 100 is assembled, the flange 102 and extension 104 vertically overlap and are in sliding contact via the sliding layer 106. The curvature of the flange 102 conforms to the curvature of the proximal end of the finger unit 120, and the curvature of the extension 104 conforms to the curvature of the side surface of the back plate 134. The sliding layer 106 permits the extension 104 to slide relative to the flange 102 in a plane parallel to the sliding plane, thereby allowing the finger unit 120 to rotate relative to the base plate 28/back plate 134 about the pivot axis on the sliding plane. However, the vertical overlap of the flange 102 and the extension 104 prevent the finger unit 120 from rotating relative to the base plate 28/back plate 134 out of the sliding plane. In other words, the flange 102 and extension 104 serves as the cantilever mechanism to provide a cantilever support to the finger unit 20 and prevent the finger unit from uplifting when weight is applied on the finger ends across the expansion gap G.

The sliding layer 106 can be made of the same material as the top sliding ring 16 and bottom sliding ring 18, or alternatively, with another low-friction sliding material as known in the art.

To provide additional uplift resistance, the finger joint apparatus 100 of the second embodiment can optionally be provided with the rigid collar of the first embodiment. Alternatively, the finger joint apparatus 100 of the second embodiment can be provided with a conventional pivot mechanism that does not include a rigid collar to provide cantilevering support.

Referring now to FIGS. 9 to 12 and according to a third embodiment, a cantilevered expansion finger joint apparatus 200 is similar to the apparatus 100 shown in FIGS. 5 to 8, with the notable exception that the cantilever mechanism comprises a flanged back plate 234 and a cut out 204 on the finger unit 220. That is, the finger unit 220 is cantilevered to the base plate 28 by means of a cantilever mechanism comprising the flanged back plate 234 and the cut-out finger unit 220. More particularly, the back plate 234 is provided with a curved flange 202 that extends from the top surface of the back plate 234 and over a portion of the finger unit body, and the finger unit 220 comprises a cut-out 204 from its top surface that corresponds to the curved flange 202. A low-friction sliding layer 206 is affixed over the cut-out 204 (or alternatively to the bottom surface of the flange 202). When the apparatus 200 is assembled, the flange 202 and cut out 204 vertically overlap and are in sliding contact via the sliding layer 206. The curvature of the flange 202 conforms of the curvature of the cut out 206. The sliding layer 206 permits the finger unit body to slide relative to the flange 202 in a plane parallel to the sliding plane, thereby allowing the finger unit 220 to rotate relative to the base plate 28/back plate 234 about the pivot axis on the sliding plane. However, the vertical overlap of the flange 202 and the cut out 204 prevent the finger unit 220 from rotating relative to the base plate 28/back plate 234 out of the sliding plane. In other words, the flange 202 and cut-out 204 serve as a cantilever mechanism to provide a cantilever support to the finger unit 220 and prevents the finger unit 220 from uplifting when weight is applied on the finger ends across the expansion gap G.

Preferably, the cut-out 204 has a depth that corresponds to the thickness of the flange 202, such that top surfaces of the flange 202 and finger unit 220 are flush.

The sliding layer 206 can be made of the same material as the top sliding ring 16 and bottom sliding ring 18, or alternatively, with another low-friction sliding material as known in the art.

To provide additional uplift resistance, the finger joint apparatus 200 of the third embodiment can optionally be provided with the rigid collar of the first embodiment. Alternatively, the finger joint apparatus 200 of the third embodiment can be provided with a conventional pivot mechanism that does not comprise a rigid collar to provide cantilevering support.

Figure 13:
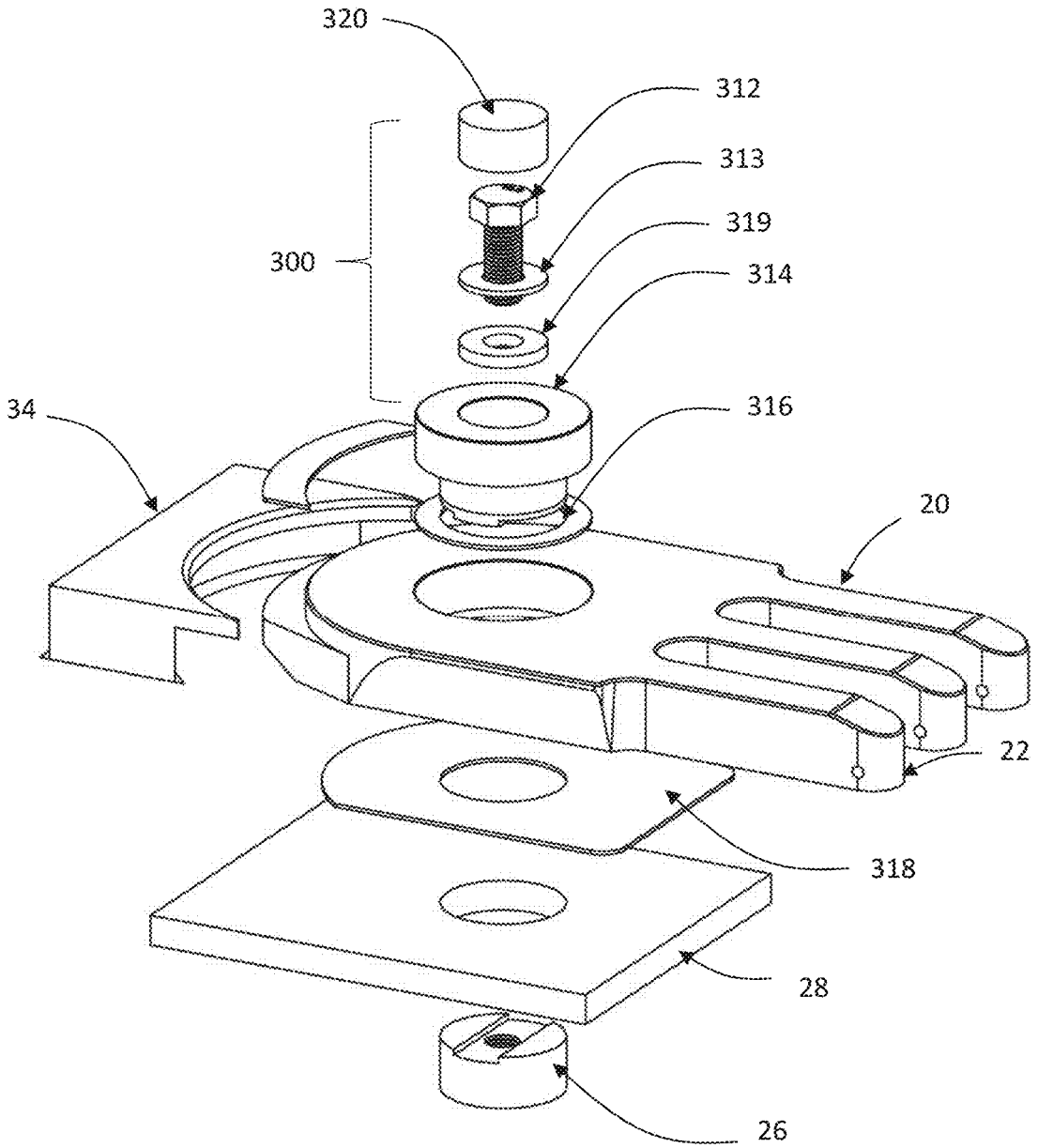
FIG. 13 is an exploded perspective view of a cantilevered expansion finger joint comprising a cantilever mechanism having a sprung pivot mechanism according to another embodiment.
Figure 14:
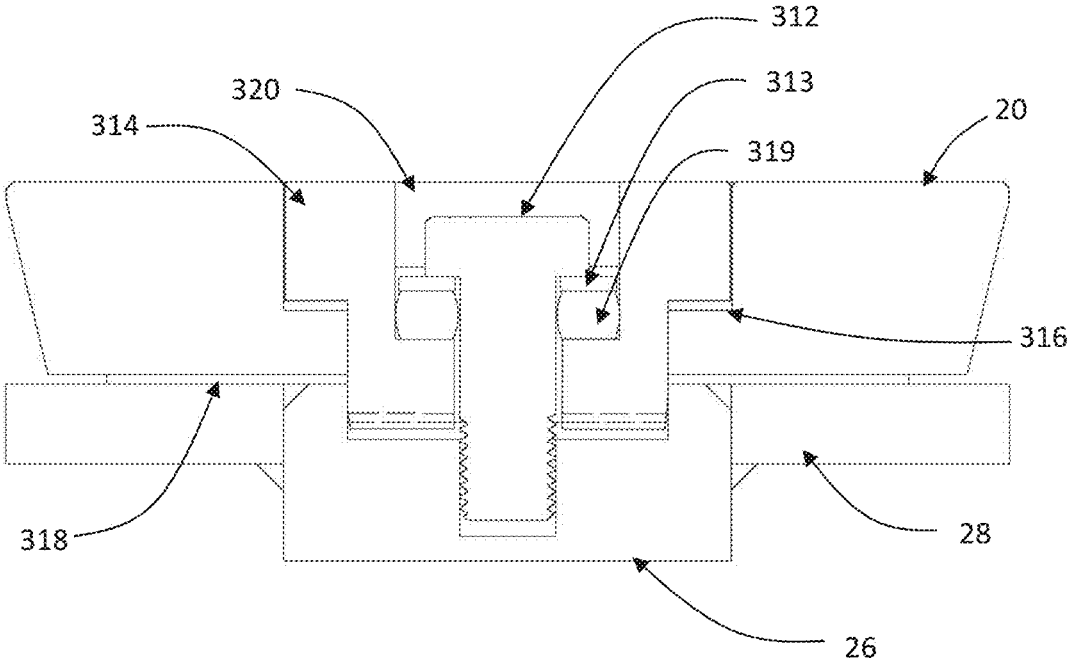
FIG. 14 is a sectioned partial side elevation view of the sprung pivot mechanism of the cantilever mechanism shown in FIG. 13.

Referring to FIGS. 13 and 14 and according to an alternative embodiment, a sprung pivot mechanism 300 can be used in any of the aforementioned cantilevered expansion finger joint apparatus embodiments.

Like the pivot mechanism shown in FIGS. 1-9, the sprung pivot mechanism 300 comprises a top anchor bolt 312, a rigid collar 314, a top sliding ring 316, a bottom sliding ring 318 and a base plate anchor 26, permanently connected to the base plate, which serves to prevent the rigid collar 314 from rotating and further allows free downwards movement of collar 314 with wear of the top/or bottom sliding rings. Additionally, the rigid collar 314 comprises a lower section, through which all horizontal loads are transferred to the base plate and structure, extending through the annular seat 25 of the bore 24, and the sprung pivot mechanism 300 further comprises a steel washer 313 and a spring 319 located in a gap in between the head of the top anchor bolt 312 and an annular seat of the rigid collar 319. A rubber plug 320 or sealant (not shown) fills the open space between the top anchor bolt head 313 and the bore of the rigid collar 314.

The spring 319 can be a ring made of an elastic compressible material such as urethane or rubber. The spring 319 is intended to reduce fatigue of the top anchor bolt 312 due to repetitive traffic loading. When the top anchor bolt 312 is tensioned, it compresses the spring 319. If the top and/or bottom sliding rings 316, 318 wear and become thinner, the compressed spring 319 will expand and the top anchor bolt 312 is expected to remain in sufficient tension to hold the rigid collar 314 in place and prevent the rigid collar 314 and therefore the finger unit 20 from becoming loose and/or rattling when traffic passes over. If there is any play in the finger joint apparatus due to fabrication intolerances or uneven wear, the finger joint apparatus is expected to still function. The cantilever mechanism is still expected to prevent the finger plate from rotating in a vertical plane.

All shear forces in the horizontal plane are resisted by the rigid collar 314. The top anchor bolt 312 only experiences axial tension. The gap between the collar 314 and the top anchor bolt 312 ensures that the top anchor bolt 312 does not experience any bending.

The terminology used herein is for the purpose of describing particular embodiments only and is not intended to be limiting. Accordingly, as used herein, the singular forms "a", "an" and "the" are intended to include the plural forms as well, unless the context clearly indicates otherwise. It will be further understood that the terms "comprises" and "comprising," when used in this specification, specify the presence of one or more stated features, integers, steps, operations, elements, and components, but do not preclude the presence or addition of one or more other features, integers, steps, operations, elements, components, and groups. Directional terms such as "top", "bottom", "upwards", "downwards", "vertically", and "laterally" are used in the following description for the purpose of providing relative reference only, and are not intended to suggest any limitations on how any article is to be positioned during use, or to be mounted in an assembly or relative to an environment. Additionally, the term "couple" and variants of it such as "coupled", "couples", and "coupling" as used in this description are intended to include indirect and direct connections unless otherwise indicated. For example, if a first device is coupled to a second device, that coupling may be through a direct connection or through an indirect connection via other devices and connections. Similarly, if the first device is communicatively coupled to the second device, communication may be through a direct connection or through an indirect connection via other devices and connections.

It is contemplated that any part of any aspect or embodiment discussed in this specification can be implemented or combined with any part of any other aspect or embodiment discussed in this specification.

The scope of the claims should not be limited by the preferred embodiments set forth in the examples, but should be given the broadest interpretation consistent with the description as a whole.

What is claimed is:

1. An expansion joint apparatus comprising one or more finger joints with each finger joint comprising a) a support for anchoring to a surface of a supporting structure;

b) a finger unit comprising a finger unit body and one or more fingers extending from a distal end of the finger unit body;

c) a pivot mechanism pivotally coupling the finger unit to the support and allowing rotation about a pivot axis on a sliding plane parallel to a top surface of the support, and comprising a pivot bore extending through the finger unit body along the pivot axis; and d) a cantilever mechanism contacting the finger unit to provide cantilever support to the one or more fingers, wherein rotation within the sliding plane is allowed but rotation out of the sliding plane is prevented, and comprising a rigid collar slidably seated in the pivot bore and fastened to the support such that the finger unit is rotatable relative to the collar about the pivot axis but fixed relative to the collar about any other axis.

2. The apparatus as claimed in claim 1 wherein the cantilever mechanism further comprises a flange fixed to the support and an extension fixed to the finger unit, wherein the flange overlaps the extension in a plane parallel to the sliding plane thereby impeding pivoting of the finger unit out of the sliding plane and wherein the extension is laterally slidable relative to the flange thereby allowing pivoting of the finger unit in the sliding plane about the pivot axis only.

3. The apparatus as claimed in claim 1 wherein the cantilever mechanism further comprises a flange fixed to the support, wherein the flange overlaps a proximal end of the finger unit in a plane parallel to the sliding plane, thereby impeding pivoting of the finger unit out of the sliding plane and wherein the proximal end of the finger unit is laterally slidable relative to the flange thereby allowing pivoting of the finger unit in the sliding plane about the pivot axis only.

4. The apparatus as claimed in claim 3 wherein the proximal end of the finger unit comprises a cut out corresponding to a thickness of the flange, such that top surfaces of the flange and finger unit are flush.

5. The apparatus as claimed in claim 1 wherein the collar is seated and the pivot mechanism comprises a top sliding surface, a bottom sliding surface and a top anchor fastener, wherein the top sliding surface is seated in the collar, and the bottom sliding surface is located between the finger unit and the support, and the top anchor fastener is seated on the top sliding surface and extends through the top sliding surface, the collar, the bottom sliding surface and is fixed to the support, and wherein the top and bottom sliding surfaces have a low friction surface permitting the finger unit to slide relative to the collar and the support when the top anchor fastener is connected to the support.

6. The apparatus as claimed in claim 1 wherein the finger unit body further comprises a top surface, a bottom surface and side surfaces that taper inwardly from the top surface to the bottom surface.

7. The apparatus as claimed in claim 1 further comprising a bottom anchor fastener extending downwards from a base plate.

8. The apparatus as claimed in claim 1 further comprising at least one pair of the finger joints, wherein a first finger joint faces a second finger joint of each of the at least one pair and are spaced apart across an expansion gap, and wherein fingers from the first and second finger joints of each of the at least one pair intermesh over the expansion gap.

9. The apparatus as claimed in claim 8 comprising multiple pairs of the finger joints, wherein the first finger joint of each pair are positioned side-by-side on one side of an expansion gap, and the second finger joint of each pair are positioned side-by-side on an opposite side of the expansion gap, such that the intermeshing fingers extend across the expansion gap.

10. The apparatus as claimed in claim 5 wherein the pivot mechanism further comprises a spring compressed along the pivot axis and expandable upon wear of the top or bottom sliding surface to maintain the pivot mechanism in contact with the finger unit.

11. The apparatus as claimed in claim 10 wherein the spring is composed of an elastic compressible material.

* * * * *